US007958587B1

(12) United States Patent
Hansen

(10) Patent No.: US 7,958,587 B1
(45) Date of Patent: Jun. 14, 2011

(54) CONCRETE HOLE BRUSH APPARATUS

(76) Inventor: Troy E. Hansen, Lancaster, CA (US)

( * ) Notice: Subject to any disclaimer, the term of this patent is extended or adjusted under 35 U.S.C. 154(b) by 155 days.

(21) Appl. No.: 12/427,456

(22) Filed: Apr. 21, 2009

(51) Int. Cl.
*A46B 13/02* (2006.01)

(52) U.S. Cl. ..... 15/23; 15/106; 134/6; 33/542

(58) Field of Classification Search ..... 15/21.1, 15/23, 56, 104.05, 104.09, 104.095, 104.096, 15/104.16, 104.2, 105, 106; 134/6; 33/483, 33/485, 493, 494, 836, 542; 7/163–164; 81/DIG. 5
See application file for complete search history.

(56) References Cited

U.S. PATENT DOCUMENTS

| | | | | |
|---|---|---|---|---|
| 29,833 | A * | 9/1860 | Hathaway | 408/212 |
| 3,293,680 | A * | 12/1966 | Wilson et al. | 15/104.095 |
| 4,527,449 | A * | 7/1985 | Sydlowski et al. | 76/108.1 |
| 4,850,071 | A | 7/1989 | Lawrence | |
| 5,224,231 | A | 7/1993 | Nacar | |
| 5,406,669 | A | 4/1995 | Lesiw | |
| 5,636,400 | A | 6/1997 | Young | |
| 5,667,509 | A | 9/1997 | Westin | |
| 5,809,601 | A | 9/1998 | Rivera | |
| D521,241 | S | 5/2006 | Dimmerling | |
| 7,699,852 | B2 * | 4/2010 | Frankel et al. | 606/92 |
| 2009/0240164 | A1 * | 9/2009 | Gillespie | 600/569 |

* cited by examiner

*Primary Examiner* — Laura C Guidotti
(74) *Attorney, Agent, or Firm* — Crossley Patent Law; Mark A. Crossley

(57) ABSTRACT

The concrete hole brush apparatus provides a tool and method for rapidly and effectively cleaning holes drilled in concrete. The holes must be clean of all debris and dust for an effective bond of anchors with the concrete. Brush sizes include ½ inch, ⅝ inch, ¾ inch, ⅞ inch, 1 inch, 1⅛ inch, and 1¼ inch. The apparatus chucks into a variety of power drills, with the shaft size reduced to a chuck tip for best fit to those drills. The measurement indicia ensure that an operator penetrates to the entire hole depth to guarantee cleanliness. The concrete hole brush apparatus saves time in cleaning concrete holes and negates problems in concrete hole inspections by a concrete inspector.

6 Claims, 3 Drawing Sheets

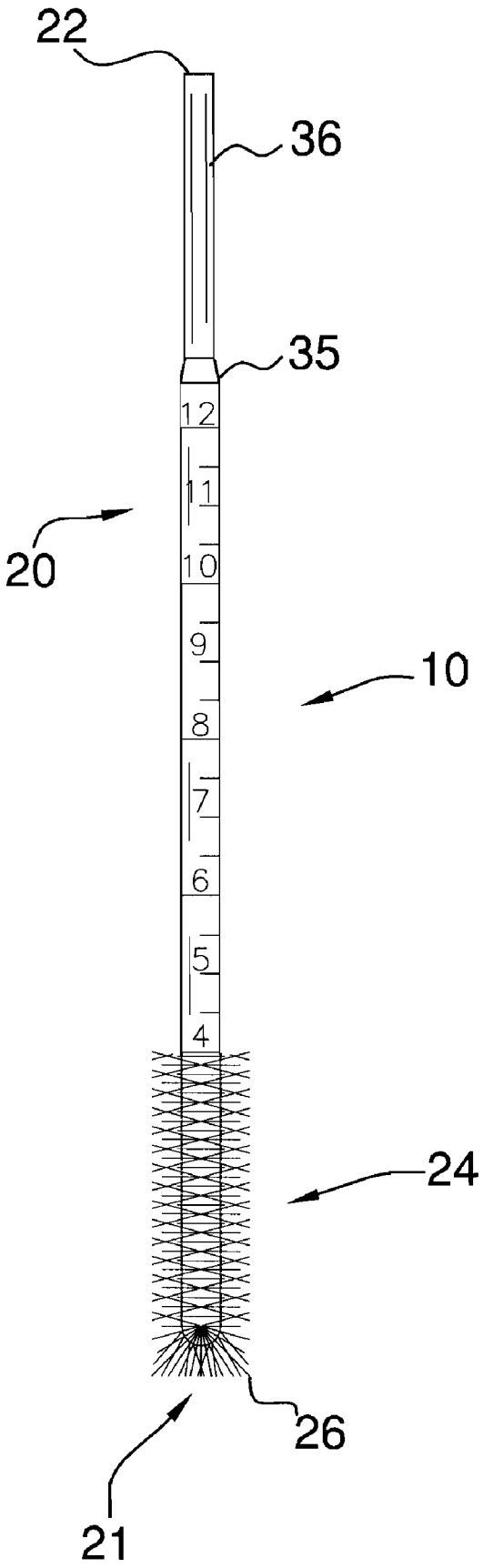
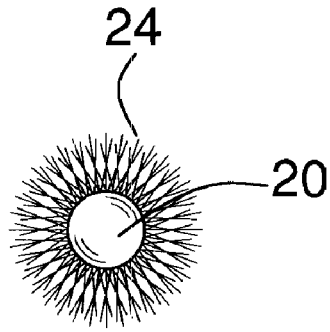
FIG. 3
FIG. 2

CONCRETE HOLE BRUSH APPARATUS

BACKGROUND OF THE INVENTION

A problem exists in properly cleaning holes drilled in concrete that are intended to have various anchors bonded within them. Anchors such as dowels and bolts are typical in such applications. Anchors are typically bonded within the holes with various forms of catalyzed cements. Any failure to bond is unacceptable. To that end, concrete inspectors typically inspect holes to determine their cleanliness prior to any anchor bonding therewithin. In the past, such concrete holes are cleaned by hand with a brush that is inserted into each hole. Obviously, this is a laborious, time consuming task. To add to the difficulty, holes are drilled into the concrete at particularly specific depths. Any cleaning must be certain of reaching the full depth of each hole, with the typically angled or conical hole bottom also thoroughly cleaned.

The present apparatus provides for fit to a power drill and provides for thoroughly cleaning each concrete hole rapidly and effectively, with measurement indicia along the shaft to ensure that the brush reaches the full limits of each hole.

FIELD OF THE INVENTION

The concrete hole brush apparatus relates to cleaning tools and more especially to a brush apparatus for fit to a rotating power tool such as a drill, the apparatus especially effective in cleaning concrete holes.

SUMMARY OF THE INVENTION

The general purpose of the concrete hole brush apparatus, described subsequently in greater detail, is to provide a concrete hole brush apparatus which has many novel features that result in an improved concrete hole brush apparatus which is not anticipated, rendered obvious, suggested, or even implied by prior art, either alone or in combination thereof.

To attain this, the concrete hole brush apparatus provides a tool for rapidly and effectively cleaning holes drilled in concrete. As noted, the holes are used in anchoring various anchors such as bolts and dowels that must be bonded within the holes. The holes must be clean of all debris and dust for an effective bond with the concrete. The present apparatus is provided in a plurality of brush sizes so that various sized concrete holes can be properly cleaned.

Brush sizes include ½ inch, ⅝ inch, ¾ inch, ⅞ inch, 1 inch, 1⅛ inch, and 1¼ inch. The apparatus chucks into a variety of power drills, with the shaft size reduced to a chuck tip for best fit to those drills. The measurement indicia ensure that an operator penetrates to the entire hole depth to guarantee cleanliness. Further, the conical brush tip enables the brush to reach the hole end, which is typically tapered due to bit construction. The defined brush end assists in removal of debris and dust from a concrete hole.

The concrete hole brush apparatus saves time in cleaning concrete holes and negates problems in concrete hole inspections by a concrete inspector.

Thus has been broadly outlined the more important features of the improved concrete hole brush apparatus so that the detailed description thereof that follows may be better understood and in order that the present contribution to the art may be better appreciated.

An object of the concrete hole brush apparatus is to provide a concrete hole cleaning apparatus for fit to a power drill.

Another object of the concrete hole brush apparatus is to effectively and quickly clean a concrete hole to ensure bonding agent adhesion.

A further object of the concrete hole brush apparatus is to provide measurement indicia to ensure that the entire hole depth is cleaned.

An added object of the concrete hole brush apparatus is to save time in cleaning concrete holes.

And, an object of the concrete hole brush apparatus is to negate problems in concrete hole inspections by a concrete inspector.

Still another object of the concrete hole brush apparatus is to provide a plurality of brush sizes for cleaning a plurality of concrete hole sizes.

These together with additional objects, features and advantages of the improved concrete hole brush apparatus will be readily apparent to those of ordinary skill in the art upon reading the following detailed description of presently preferred, but nonetheless illustrative, embodiments of the improved concrete hole brush apparatus when taken in conjunction with the accompanying drawings.

In this respect, before explaining the current embodiments of the improved concrete hole brush apparatus in detail, it is to be understood that the concrete hole brush apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved concrete hole brush apparatus. It is therefore important that the claims be regarded as including such equivalent constructions insofar as they do not depart from the spirit and scope of the concrete hole brush apparatus. It is also to be understood that the phraseology and terminology employed herein are for purposes of description and should not be regarded as limiting.

BRIEF DESCRIPTION OF THE DRAWINGS

FIG. 2 is a lateral elevation view.

FIG. 3 is an end elevation view.

DETAILED DESCRIPTION OF THE DRAWINGS

With reference now to the drawings, and in particular FIGS. 1 through 4 thereof, the principles and concepts of the concrete hole brush apparatus generally designated by the reference number 10 will be described.

Figure 1:
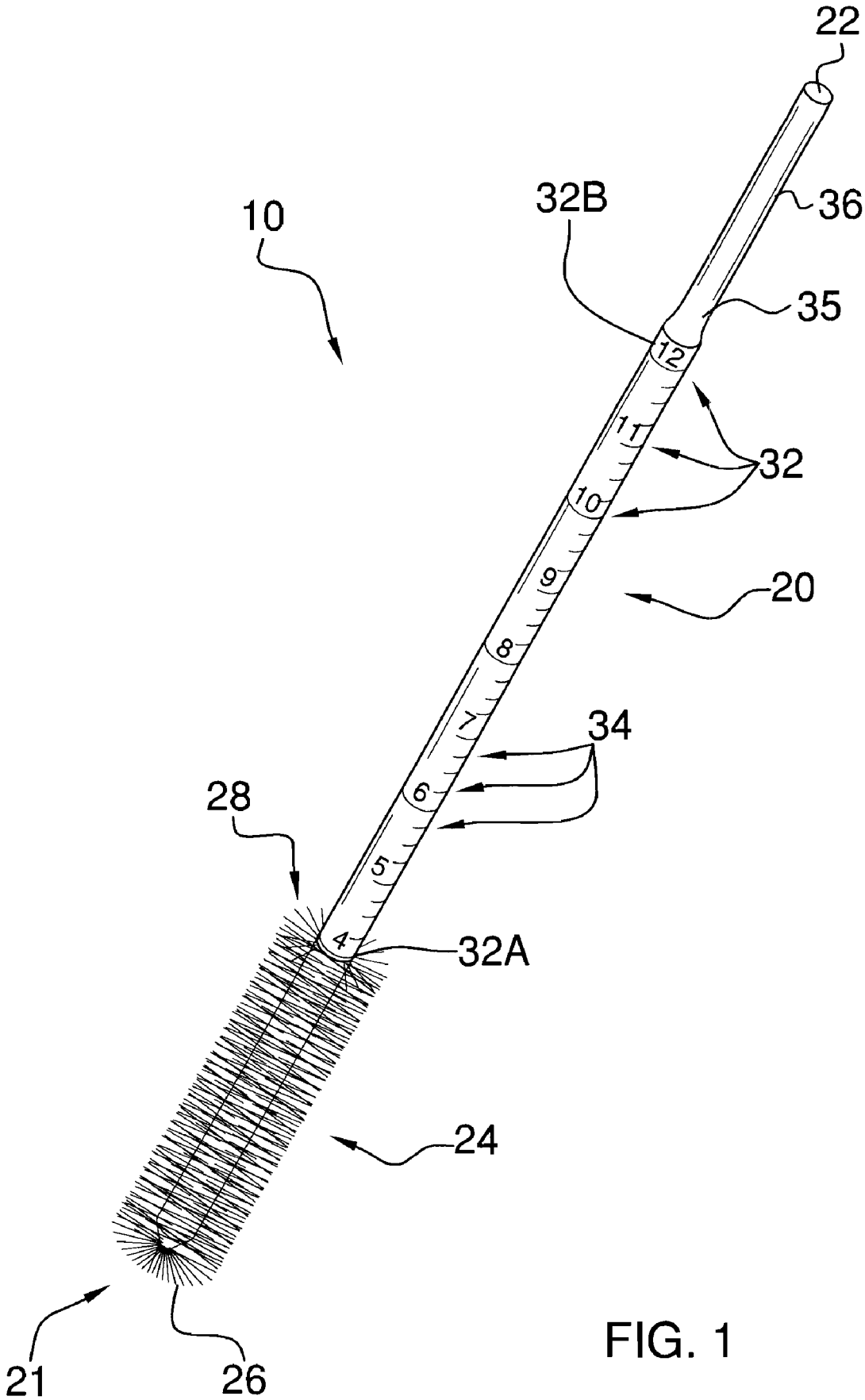
FIG. 1 is a perspective view.

Referring to FIGS. 1, 2, and 3, the apparatus 10 comprises the straight shaft 20 having a first end 21, a second end 22, and a length of at least 13 inches therebetween. The cylindrically shaped brush 24 is disposed adjacent to the shaft 20 first end 21. The conical brush tip 26 is disposed at the shaft 20 first end 21. The defined brush end 28 is disposed at the 4 inch mark 32*a* on the shaft 20. The defined brush end 28 is perpendicular to the shaft 20 length. Measurement indicia 32 is disposed on the shaft 20. The indicia 32 is disposed from the 4 inch mark 32*a* to the 12 inch mark 32*b*. The indicia 32 is in ¼ inch increments 34. The taper 35 is extended from the 12 inch mark 32*b*. The reduced diameter chuck tip 36 is between the taper 35 and the shaft 20 second end 22. The chuck tip 36 is removably fitted into an existing drill chuck 82 of an existing power drill 80.

Figure 4:
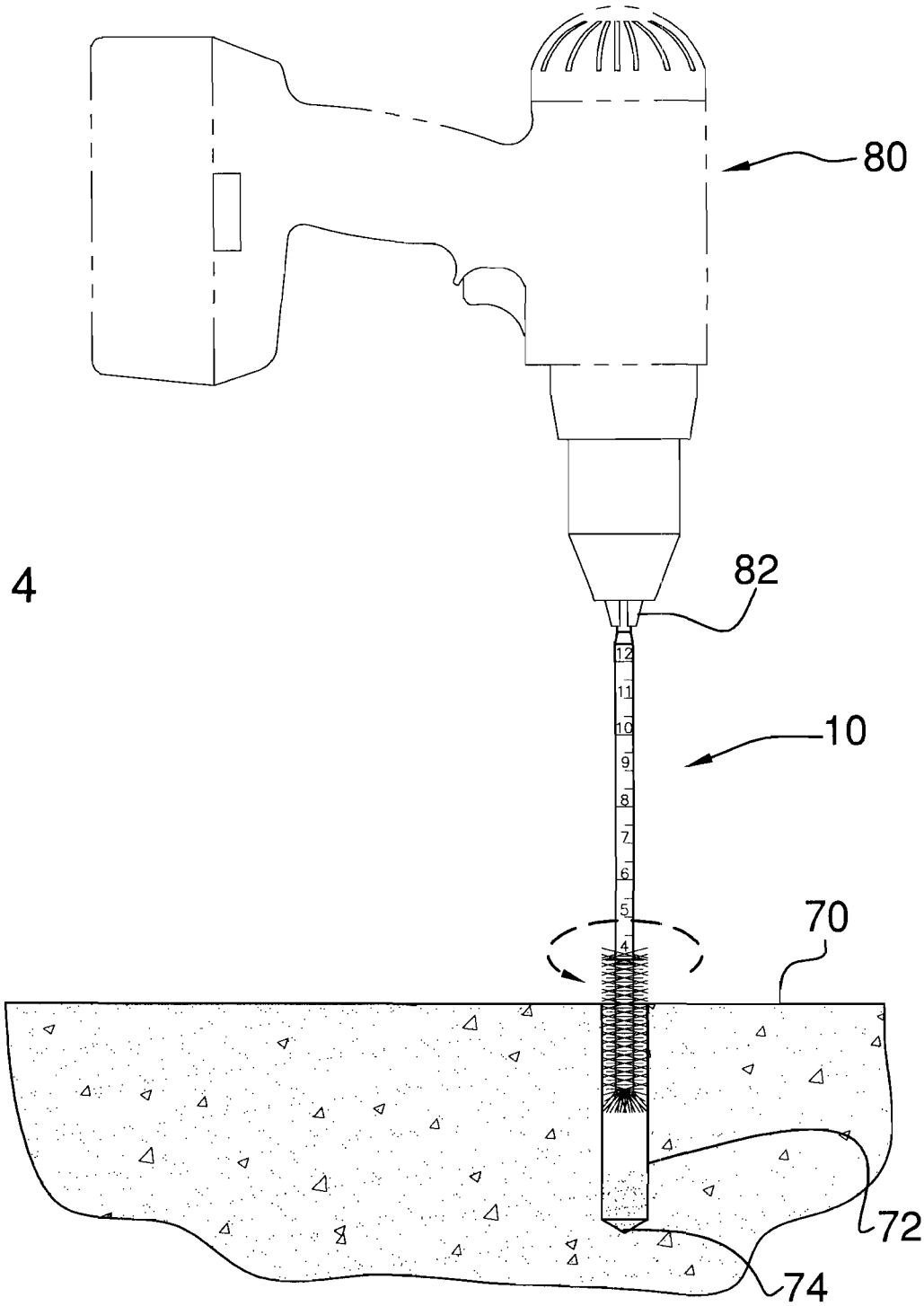
FIG. 4 is a lateral elevation view of the apparatus in use with a power drill.

Referring to FIG. 4, proper use of the apparatus 10 comprises inserting the apparatus 10 chuck tip 36 into an existing chuck 82 of an existing power drill 80, then tightening the chuck 82 on the chuck tip 36. The next step is measuring the depth of the hole 72 in the concrete 70. Next comes inserting the apparatus 10 into the hole 72 whereby the measurement indicia 32 equals the depth of the hole 72. Rotating the chuck 82 of the power drill 80, typically by an existing trigger, cleans the hole 72. The final action comprises extracting the apparatus 10 from the hole 72. The conical brush tip 26 assures that the hole end 74 is also cleaned.

With respect to the above description then, it is to be realized that the optimum dimensional relationships for the parts of the concrete hole brush apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the concrete hole brush apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the concrete hole brush apparatus may be used.

Therefore, the foregoing is considered as illustrative only of the principles of the concrete hole brush apparatus. Further, since numerous modifications and changes will readily occur to those skilled in the art, it is not desired to limit the concrete hole brush apparatus to the exact construction and operation shown and described, and accordingly, all suitable modifications and equivalents may be resorted to, falling within the scope of the concrete hole brush apparatus.

What is claimed is:

1. A concrete hole brush apparatus, comprising:

a straight shaft having a first end, a second end, and a length of at least 13 inches therebetween;

a cylindrically shaped brush disposed adjacent to the shaft first end;

a defined brush end at a 4 inch mark on the shaft, the 4 inch mark 4 inches from the shaft first end, the defined brush end perpendicular to the shaft length;

a measurement indicia on the shaft, the indicia disposed from the 4 inch mark to a 12 inch mark, the indicia between the defined brush end and the shaft second end;

a taper extended from the 12 inch mark toward the shaft second end;

a reduced diameter chuck tip between the taper and the shaft second end, the chuck tip removably fitted into an existing chuck of an existing power drill.

2. The apparatus according to claim 1 wherein the cylindrically shaped brush further comprises a conical brush tip disposed on the shaft first end.

3. The apparatus according to claim 2 wherein the measurement indicia further comprises indicia in ¼ inch increments.

4. The apparatus according to claim 1 wherein the measurement indicia further comprises indicia in ¼ inch increments.

5. A concrete hole brush apparatus, comprising:

a plurality straight shafts, each shaft having a first end, a second end, and a length of at least 13 inches therebetween;

a plurality of cylindrically shaped brushes, each brush individually included into the shaft first end on one straight shaft, the brushes provided in diameters consisting of ½ inch, ⅝ inch, ¾ inch, ⅞ inch, 1 inch, 1⅛ inch, and 1¼ inch;

a conical brush tip disposed on each shaft first end;

a defined brush end at a 4 inch mark on each shaft, the 4 inch mark 4 inches from the shaft first end, the defined brush end perpendicular to the shaft length;

a measurement indicia on each shaft, the indicia disposed from the 4 inch mark to a 12 inch mark, the indicia between the defined brush end and the shaft second end, the measurement indicia in ¼ inch increments;

a taper extended from the 12 inch mark;

a reduced diameter chuck tip between the taper and the shaft second end, the chuck tip removably fitted into an existing chuck of an existing power drill.

6. A method of cleaning a hole in concrete with a concrete hole brush apparatus, the apparatus comprising a straight shaft having a first end, a second end, and a length of at least 13 inches therebetween, a cylindrically shaped brush disposed adjacent to the shaft first end, a defined brush end at a 4 inch mark on the shaft, the 4 inch mark 4 inches from the shaft first end, the defined brush end perpendicular to the shaft length, a conical brush tip disposed on the shaft first end, a measurement indicia on the shaft, the indicia disposed from the 4 inch mark to a 12 inch mark, the indicia between the defined brush end and the shaft second end, the indicia in ¼ inch increments, a taper extended from the 12 inch mark, a reduced diameter chuck tip between the taper and the shaft second end, wherein the method comprises:

inserting the apparatus chuck tip into an existing chuck of an existing power drill;

tightening the chuck on the chuck tip;

measuring a depth of the hole in concrete;

inserting the apparatus into the hole whereby the measurement indicia equals the depth of the hole in concrete;

rotating the chuck of the power drill;

extracting the apparatus from the hole.

* * * * *